United States Patent [19]

Bornancini

[11] 4,391,057

[45] Jul. 5, 1983

[54] ACTUATOR SYSTEM FOR THE RETURN OF THE TRIGGER IN DOUBLE-ACTION REVOLVERS

[75] Inventor: Jose C. M. Bornancini, Porto Alegre, Brazil

[73] Assignee: Forjas Taurus S/A, Porto Alegre, Brazil

[21] Appl. No.: 219,432

[22] Filed: Dec. 23, 1980

[30] Foreign Application Priority Data

Dec. 27, 1979 [BR] Brazil ..... 7908531[U]

[51] Int. Cl.[3] ..... F41C 1/00; F41C 19/00

[52] U.S. Cl. ..... 42/65

[58] Field of Search ..... 42/65, 66, 69 R, 59

[56] References Cited

U.S. PATENT DOCUMENTS

| | | | |
|---|---|---|---|
| 3,055,270 | 9/1962 | Miller | 42/65 |
| 3,245,167 | 4/1966 | Freed | 42/65 |
| 3,903,630 | 9/1975 | Dirstine | 42/65 |
| 4,067,131 | 1/1978 | Ruger et al. | 42/65 |
| 4,109,402 | 8/1978 | Guardamino | 42/65 |
| 4,213,263 | 7/1980 | Brouthers | 42/65 |

OTHER PUBLICATIONS

Ruger, "The Ruger Redhawk", pp. 60 & 61.

".44 Magnum" *1982 Guns & Ammo Annual,* p. 82.

*Primary Examiner*—Charles T. Jordan

*Attorney, Agent, or Firm*—Emory L. Groff, Jr.

[57] ABSTRACT

An actuator system for the trigger return in double-action revolvers includes an actuating rod having a rounded end engaged in a recess in the trigger with a helical coiled return spring biasing the rod by means of a cylindrical shoulder thereon and a rotary abutment member having a bore, which bore serves as a guide for the axially shiftable rod. The system provides an improved double-action operation since it compensates for the increasing reaction of the spring by reducing the lever arm or moment of this reaction on the trigger during its rearward movement. An improvement enables the user to control the "trigger weight" in a single-action operation by the provision of a return spring control bushing which can be adjustably threaded in the rotary abutment member to vary the effective operating length of the spring.

15 Claims, 5 Drawing Figures

ACTUATOR SYSTEM FOR THE RETURN OF THE TRIGGER IN DOUBLE-ACTION REVOLVERS

This invention relates to improvements in the actuator system for the return of the trigger in double-action revolvers. In the various types of double-action revolvers, there are used variations of one of the three systems below for assuring the return of the trigger: (1) type Colt; (2) Ruger type such as employed in (Dan Wesson, Charter Arms, High Standard and Colt Tropper revolvers); (3) Smith & Wesson type (such as found in Astra, Llama, Manurhin, Taurus and Rossi revolvers.

The Colt type trigger return system involves a particular V-spring, one arm of which acts as the main spring for the hammer and the other arm of which acts as the trigger return spring. The Ruger type return system depends upon a coil spring of the "clothes-pin" type in which two extensions of the end coils act respectively on the trigger and on a bearing. In the Smith & Wesson return system, a sliding trigger actuator member is provided having a longitudinal bore and slot. Within this bore, a coil spring is located which biases the member forwardly and acts upon the trigger by means of a connecting rod or plunger linked thereto. The trigger actuator has the additional purpose of safety for the firearm, since it is provided with a back shoulder which causes the hammer to retract from the striking position to a safety position when the actuator returns to the position corresponding to trigger rest. In this safety position, the firing pin or needle cannot reach the cartridge even if the hammer strikes accidentally.

The low effectiveness obtained in many of the earlier systems led to the same Smith & Wesson to develop further safety devices such as those disclosed in U.S. Pat. Nos. 1,122,635, issued Dec. 29, 1914 and 2,470,259 issued May 17, 1949. The device described in the latter of these patents and which is still in use, consists of a steel shank actuated by the trigger actuator itself and which in the rest position thereof, will be interposed between the hammer and the frame, thus preventing the hammer from accidentally striking.

The trigger actuator system provided with this additional safety device has been imitated with minor changes. For instance, in the Manurhin revolver, the actuator is provided with rollers to reduce friction thereof on the frame. As to the additional safey device, more radical and efficient changes have been made. For example, in the revolvers by Taurus and Manurhin, the lock rod is actuated by the trigger itself rather than by the actuator as in the original system.

However, the most important advantage of the Smith & Wesson system for trigger return, over the aforementioned other systems, is its smoothness and thus the efficiency as provided in double-action operation. This occurs because, whereas in the two other systems, the resistance to the movement of trigger squeezing increases with the compression of the respective return spring, in the Smith & Wesson system, the increasing reaction of the spring is compensated for or attenuated, by modification of the geometrical arrangement of its components. Thus, when the actuator is in a forward position, corresponding to the final rest position of the trigger, the direction of the separate plunger element axis determines a maximum momentum in relation to the trigger rotational axis. As the trigger rotates upon being squeezed, the plunger axis also moves angularly and its line of force or action tends to pass through the rotational axis of the trigger. Therefore, the momentum acting on the trigger will be reduced and this will compensate for the increasing compression of the spring. For this reason, there is obtained a "weight" of the trigger in double-action operation which decreases as the firing instant approaches. In accordance with those skilled in combat quick shooting, this means an advantage since it assures a considerable improvement in the shooter performance.

Accordingly, an object of the present invention is to provide an improved actuator system for revolver trigger return which will assure the same performance as the Smith & Wesson system in double-action operation thus enhancing the smoothness thereof.

Another object of the present invention is to provide a revolver trigger return system which enables, when desired, further control of the smoothness of operation in double-action.

Still another object of the present invention is to provide control means operable with revolvers used in target practice, to vary the trigger "weight" in single-action operation.

A further object of the proposed revolver trigger return system is to provide all of these features together with a maximum degree of safety in the gun, including prevention of accidental striking of the hammer.

A still further object is to provide maximum reliability in a revolver operation by means of improved simplification and ruggedness of the system components.

Yet another object is to obtain a system whose assembly and disassembly are extremely simple.

Additionally, another object of the invention is to realize all that has been disclosed by means of a system of components which are simple and economical to manufacture.

With these and other objects in view, the advantages of the present invention will be readily apparent from the following description of a preferred embodiment, when taken in connection with the accompanying drawings, in which.

Figure 1:
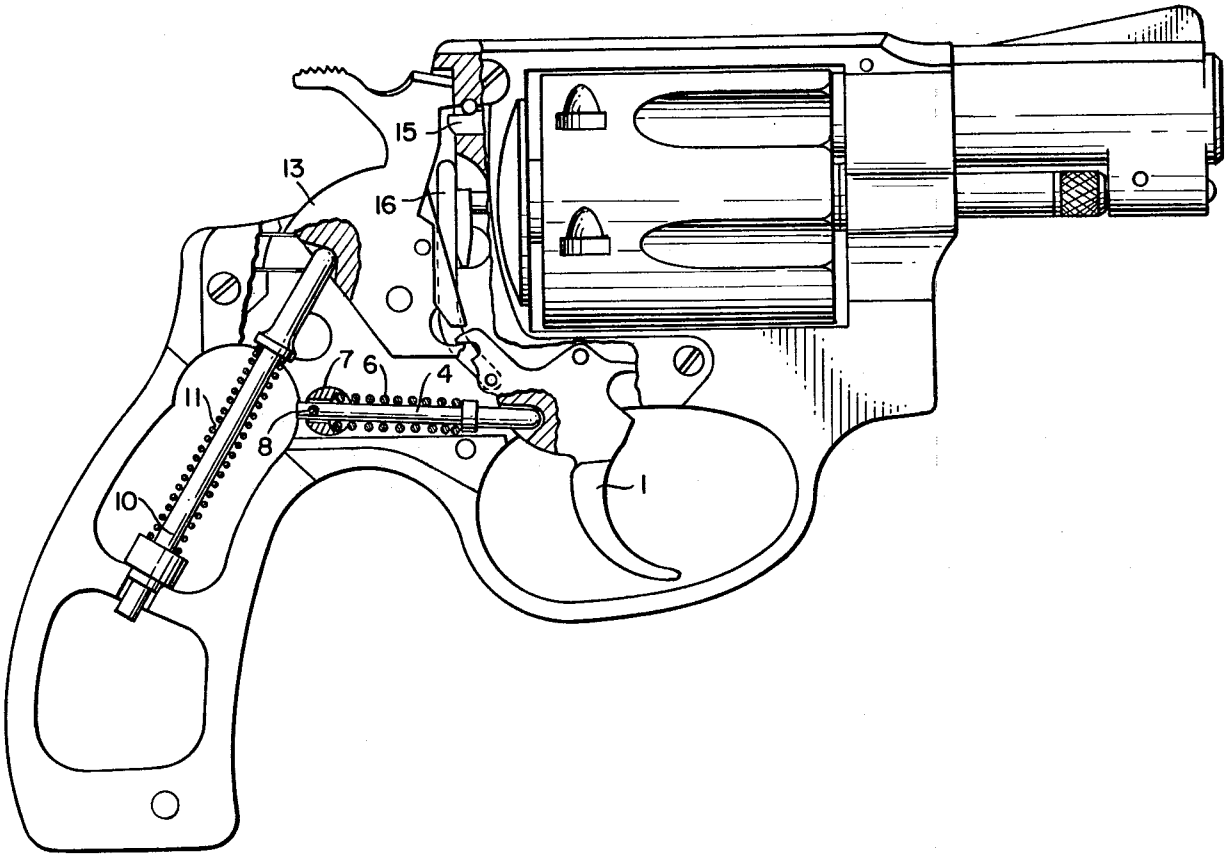
FIG. 1 is a side elevation, partially broken away, of the revolver.

The main feature of the invention resides in relacing the Smith & Wesson "trigger-actuator", which is a complicated means having problems of friction with the frame and difficulties of manufacture and assembly, by an improved system which will produce the same results but is simpler since the revolver hammer is safely actuated directly by the trigger without depending on the trigger actuator.

The system for assuring trigger return comprises simply an actuating rod 4 having a rounded tip disposed in the corresponding recess 3 of the trigger 1. The rod 4 is constantly biased toward the trigger 1 by the coiled helical spring 6 which is compressed between a cylindrical shoulder 5 on the rod and the rotary abutment member 7 mounted for pivotal displacement about a fixed transverse axis. The trigger actuating rod 4 is further provided with a disassembly bore 8 adjacent its end journaled through the abutment member 7.

Figure 2:
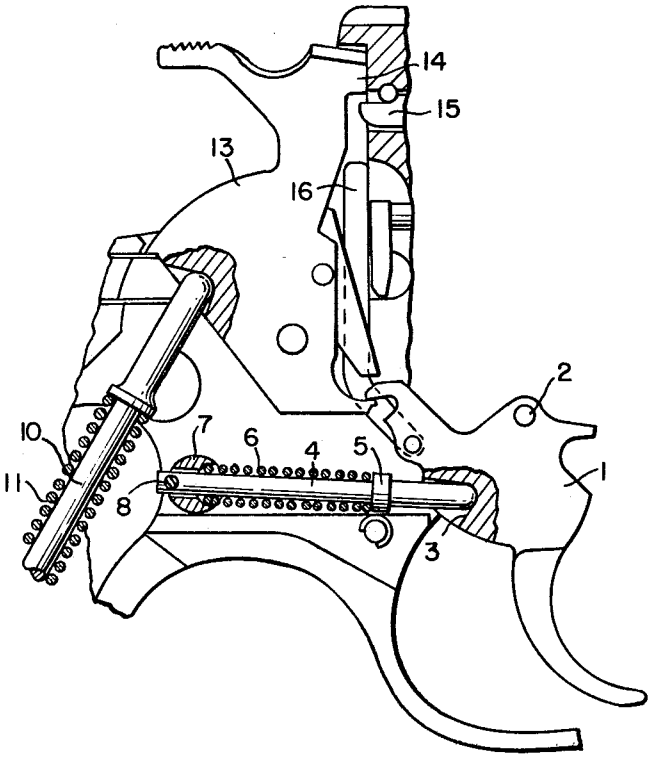
FIG. 2 is an enlarged partial side elevation of the hammer-trigger-trigger actuator assembly in the at rest position of the trigger.

As easily noted in FIG. 2, when the revolver mechanism is in the rest position of the trigger or near thereto, the direction of the rod axis and thereby of the force exerted by the spring 6, forms a maximum lever arm or force moment in relation to the pivot axis 2 of the trigger 1. That is, the rotational momentum present in the trigger due to the force of the spring 6 is of a maximum or substantial level with the components in this illustrated position with the rod axis offset such a degree with respect to the trigger axis 2.

Figure 3:
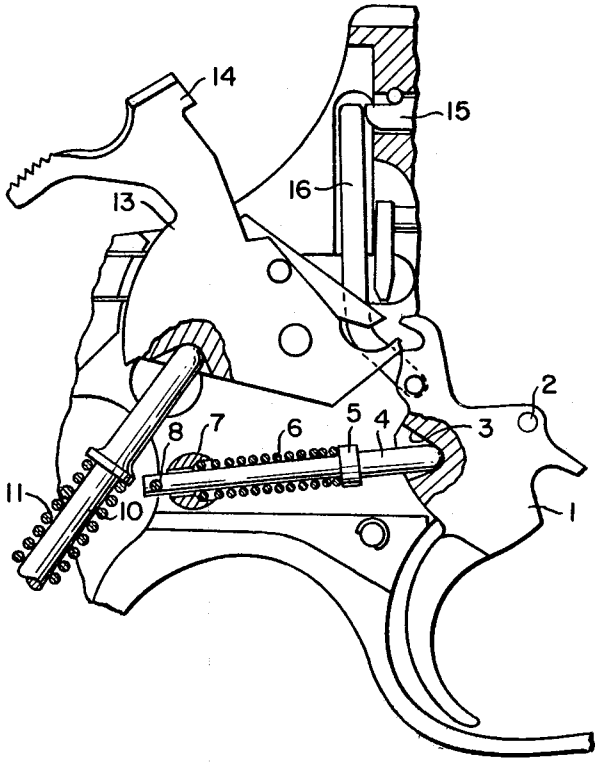
FIG. 3 is a side elevation of the assembly of FIG. 2 as it would appear in the stage immediately before the double-action hammer fall.

In FIG. 3, the position of the trigger 1 and its actuating rod 4 are disclosed as they would appear when in the double-action mode at the moment immediately before firing or release of the hammer 13. It is seen in this figure that the actuator rod 4 is axially shifted rearwardly through the abutment member 7 and the spring 6 is compressed significantly more than as in FIG. 2 but the reaction exerted thereby on the trigger is compensated or modified by the smaller lever arm or force moment in relation to the axis 2 of the trigger.

From the above it will be appreciated that there is a compensation for the stresses on the trigger which hereto fore was the main difficulty with the trigger actuator systems such as the earlier mentioned Smith & Wesson types. It is evident that this compensation for the stresses in the double-action mode is related only to the portion thereof relative to the trigger return spring 6, since it is always necessary to overcome the increasing reaction of the hammer or actual spring 11 which acts on the hammer 13 by means of the respective rod 10.

As mentioned before, experience has shown how important the trigger return actuating system is for obtaining a double-action operation which is smooth, soft and appropriate to this kind of firing.

Figure 4:
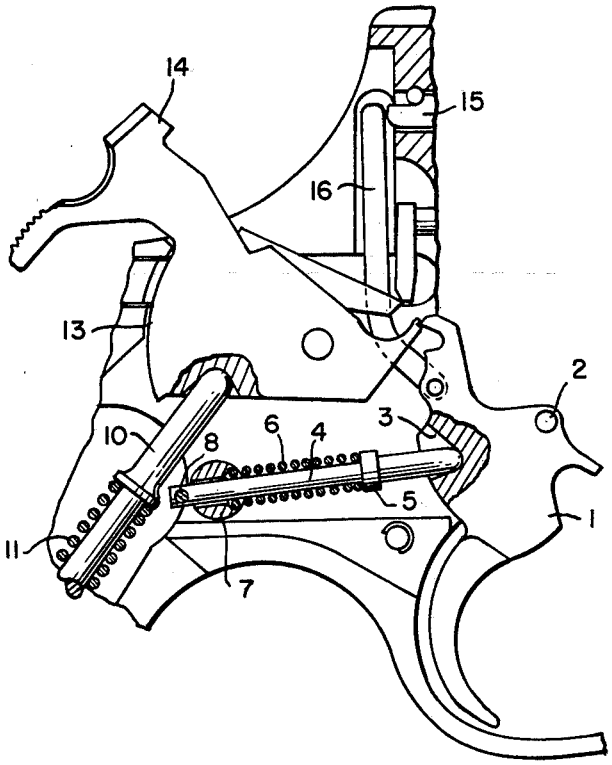
FIG. 4 is a side elevation of the assembly as it would appear with the gun cocked for single-action operation.

FIG. 4 depicts the trigger return system together with the associated hammer structure as they appear when in the cocked single-action mode whereby the present return machanism will be understood to insure a degree of precision as desired for target shooting. In this case, the force to be exerted on the trigger 1 is very small, and especially since this force does not need to overcome the reaction of the actual spring 11. Again, the present system provides an excellent touch on the trigger, since the only resistance encountered (besides friction) is the compression of the spring 6, and this has its reaction compensated by the fact that the direction of the rod axial line of action of the force is near the trigger axis 2.

Figure 5:
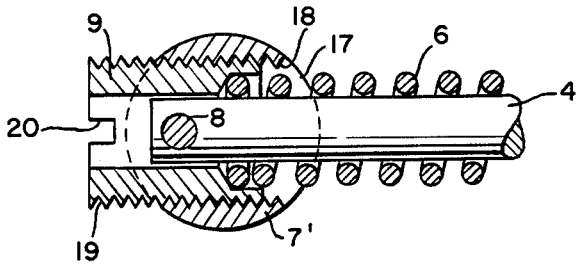
FIG. 5 is an enlarged detail of the trigger weight control mechanism.

Accordingly, it will be appreciated that the trigger "weight", that is, the force to be exerted thereon for determining firing, depends primarily (aside from friction) on the resistance of the spring 6 of the trigger return system. In this connection, the novel system of this invention allows the user in the case of guns for target practice, to exercise control over the trigger "weight" rendering it at least compatible with the rules of competition shooting. This control is obtained by a minimum of labor and is achieved by replacing the rotary abutment member 7 of the trigger spring 6 by another one 7' having an enlarged bore 17 threaded as at 18 and into which is added a control bushing 9 also threaded as at 19. FIG. 5 illustrates the details of this control, wherein the rear bearing for the spring 6 of the trigger actuating rod 4 is now formed by the forward end of the axially adjustable bushing 9. By screwing the bushing 9 in one direction compressive force of the spring 6 is increased and by unscrewing, this force is reduced.

The above variation of the effective length of the spring 6 is readily achieved by removing the side plate of the revolver and with great ease, rotating the bushing 9 to obtain the ideal control of the trigger "weight". This adjustment may be facilitated by the inclusion of tool engagement means such as one or more slots 20 in the bushing 9 as shown in FIG. 5. It is necessary to say further that the great simplification and efficiency obtained in utilizing the trigger actuation system as employed in Smith & Wesson revolvers has been only possible by the adoption of a revolver safety system which, instead of being operated by the shoulders and cams of the actuator, is operated by the trigger itself. This adopted safety system is based on a transfer bar 16 originally developed by the U.S. company, Iver-Johnson and now being in public domain, and is the system more commonly used in the present revolvers such as Ruger, Colt-Trooper, Charter Arms, High-Standard, Dan-Wesson, etc.

The transfer bar 16 as the designation indicates and by its being pivotal, transfers impact energy from the hammer 13 to the firing pin 15 only when the trigger is pulled intentionally for the firing operation. When the trigger 13 is not maintained in this ready-to-fire position, an accidental firing is impossible since the hammer upon falling, will strike with its projection 14 on the frame wall without engaging the firing pin 15. This same feature exists in the rest position of the trigger as shown in FIG. 2, since any striking on the hammer 13 cannot cause firing.

For disassembly of the trigger actuating rod system 4, it is a simple enough maneuver to remove the side plate of the gun, to cock the same and to introduce the tip of a clip into the bore 8 of the rod 4 projecting rearwardly of the abutment member 7. By unlocking the gun and pushing the trigger forwardly, the tip of rod 4 is released from its fit within the recess 3 in the trigger, and the assembly (rod-spring-abutment member) can be easily withdrawn laterally.

In the above description of the trigger return system, those components of the gun which are well known and do not contribute specifically to the present invention have not been disclosed.

Several modifications and changes in the invention can be effected without departing from the scope thereof as mentioned in the attached claims.

I claim:

1. A trigger return actuator mechanism for a double-action revolver having a hammer and trigger pivotally supported within a frame, a hammer rod provided with a mainspring and engaging said hammer, said mechanism including an actuating rod provided with a forward end bearing against said trigger, an abutment member within said frame having a bore therethrough, said actuating rod having a rear end slidably disposed through said bore, said abutment member mounted within said frame for rotary displacement about a fixed transverse axis, and spring means biasing said actuating rod forward end away from said abutment member and toward said trigger.

2. A trigger return actuator mechanism according to claim 1 wherein, said actuating rod comprises a rigid longitudinal element and said forward end is rounded and said trigger includes a recess receiving said rounded forward end.

3. A trigger return actuator mechanism according to claim 1 wherein, said actuating rod includes a transverse bore adjacent said rear end to facilitate disassembly of said actuator mechanism.

4. A trigger return actuator mechanism according to claim 1 including, a shoulder on said actuating rod intermediate said forward end and said rotary abutment member, and said spring means includes a helical coiled spring on said actuating rod bearing respectively against said shoulder and said abutment menber.

5. A trigger return actuator mechanism according to claim 1 wherein, the longitudinal axis of said actuating rod extends through said trigger along a line substantially offset from the pivot axis of said trigger when said trigger is urged to its forwardmost at-rest position and said trigger when pivoted rearwardly then axially and pivotally displaces said rod through said abutment member to relocate the extension of said rod longitudinal axis closer to said trigger pivot axis.

6. A trigger return actuator mechanism according to claim 1 wherein, said actuating rod is cylindrical and said rotary abutment member bore provides a smooth close fit with said slidably contained actuating rod.

7. A trigger return actuator mechanism according to claim 1 wherein, said rotary abutment member includes a shiftable control bushing containing said actuating rod bore and one end of said spring means engages said shiftable bushing whereby, shifting of said bushing varies the effective force of said spring means to allow adjustment of the revolver trigger weight.

8. A trigger return actuator mechanism according to claim 7 wherein, said rotary abutment member includes a second larger bore, said control bushing axially shiftable within said larger bore and threads on said bushing mating with threads in said larger bore.

9. A trigger return actuator mechanism for a double-action revolver having a hammer and trigger pivotally supported within a frame, including an actuating rod provided with a forward end bearing against said trigger, an abutment member within said frame having a bore therethrough, said rod having a rear end slidably disposed through said bore, said abutment member mounted within said frame for rotary displacement, spring means biasing said rod forward end away from said abutment member and toward said trigger, said rotary abutment member including a shiftable control bushing containing said rod bore and one end of said spring means engages said shiftable bushing whereby, shifting of said bushing varies the effective force of said spring means to allow adjustment of the revolver trigger weight.

10. A trigger return actuator mechanism according to claim 9 wherein, said actuating rod comprises a rigid longitudinal element and said forward end is rounded and said trigger includes a recess receiving said rounded forward end.

11. A trigger return actuator mechanism according to claim 9 wherein, said actuating rod includes a transverse bore adjacent said rear end to facilitate disassembly of said actuator mechanism.

12. A trigger return actuator mechanism according to claim 9 including, a shoulder on said rod intermediate said forward end and said rotary abutment member, and said spring means includes a helical coiled spring on said rod bearing respectively against said shoulder and said abutment member.

13. A trigger return actuator mechanism according to claim 9 wherein, the longitudinal axis of said rod extends through said trigger along a line substantially offset from the pivot axis of said trigger when said trigger is urged to its forwardmost at-rest position and said trigger when pivoted rearwardly axially and pivotally displaces said rod through said abutment member to reloate the extension of said rod longitudinal axis closer to said trigger pivot axis.

14. A trigger return actuator mechanism according to claim 9 wherein, said rod is cylindrical and said rotary abutment member bore provides a smooth close fit with said slidably contained rod.

15. A trigger return actuator mechanism according to claim 9 wherein, said rotary abutment member includes a second larger bore, said control bushing axially shiftable within said larger bore and threads on said bushing mating with threads in said larger bore.

* * * * *